US010173223B2

(12) United States Patent
Floeter

(10) Patent No.: US 10,173,223 B2
(45) Date of Patent: Jan. 8, 2019

(54) PROCESS FOR PRODUCING PULP FROM SUGAR BEETS

(71) Applicant: Putsch & Company, Inc., Asheville, NC (US)

(72) Inventor: Reinhard Floeter, Pelican Rapids, MN (US)

(73) Assignee: Putsch & Company, Inc., Asheville, NC (US)

( * ) Notice: Subject to any disclaimer, the term of this patent is extended or adjusted under 35 U.S.C. 154(b) by 134 days.

(21) Appl. No.: 14/729,569

(22) Filed: Jun. 3, 2015

(65) Prior Publication Data

US 2015/0343450 A1 Dec. 3, 2015

Related U.S. Application Data

(60) Provisional application No. 62/007,092, filed on Jun. 3, 2014.

(51) Int. Cl.

| | |
|---|---|
| ***B02C 18/00*** | (2006.01) |
| ***B02C 18/14*** | (2006.01) |
| ***C13B 5/06*** | (2011.01) |
| ***B02C 25/00*** | (2006.01) |
| ***B02C 18/22*** | (2006.01) |
| ***B02C 18/24*** | (2006.01) |

(52) U.S. Cl.

CPC ..... *B02C 18/142* (2013.01); *B02C 18/2225* (2013.01); *B02C 18/2291* (2013.01); *B02C 18/24* (2013.01); *B02C 25/00* (2013.01); *C13B 5/06* (2013.01)

(58) Field of Classification Search

CPC ... B02C 18/142; B02C 18/2225; B02C 18/24; B02C 18/2291; C13B 5/06

USPC ..... 241/236, 225

See application file for complete search history.

(56) References Cited

U.S. PATENT DOCUMENTS

| | | | |
|---|---|---|---|
| 627,419 | A | 6/1899 | Hoppenstedt et al. |
| 3,455,235 | A | 7/1969 | Koelsch |

(Continued)

OTHER PUBLICATIONS

The International Search Report and The Written Opinion of the International Searching Authority; dated Aug. 26, 2015, PCT Patent Application No. PCT/US2015-034042.

*Primary Examiner* — Faye Francis

(74) *Attorney, Agent, or Firm* — The Van Winkle Law Firm; William G. Heedy; David M. Carter

(57) ABSTRACT

An apparatus for producing uniformly sized sugar beet cassettes includes a frame; a first cutting shaft assembly adjacent to a second cutting shaft assembly on the frame, each of the first and second cutting shaft assemblies including a shaft in connection with a gear motor, and the gear motor being structured and disposed for mechanically rotating the shaft; a plurality of discs supported on the shaft: and a plurality of blades extending outwards from each of the plurality of discs; wherein the first and second cutting shaft assemblies are configured for interlaced counter-rotation of each of the plurality of discs; and a chute on the frame, and the chute including sidewalls defining an open-ended channel that is sized and configured for directing the sugar beet cossettes onto the first and second cutting shaft assemblies, and wherein the sugar beet cossettes are cut into uniformly sized sugar beet cossettes by the plurality of blades on each of the interlaced, counter-rotating plurality of discs.

2 Claims, 6 Drawing Sheets

(56) References Cited

U.S. PATENT DOCUMENTS

| | | | | |
|---|---|---|---|---|
| 3,477,873 | A | 11/1969 | Koelsch | |
| 4,030,670 | A * | 6/1977 | Abernathy | B02C 21/00 241/14 |
| 4,882,190 | A | 11/1989 | Olson et al. | |
| 5,526,991 | A * | 6/1996 | Bacher | B01F 13/1047 241/166 |
| 5,595,348 | A * | 1/1997 | Barone | B02C 18/0084 100/217 |
| 6,106,632 | A | 8/2000 | Ross et al. | |
| 6,357,680 | B1 * | 3/2002 | Irwin | B02C 18/142 241/167 |
| 6,663,717 | B2 | 12/2003 | Autilla et al. | |
| 7,048,215 | B2 * | 5/2006 | Irwin | B02C 18/142 241/236 |
| 7,168,640 | B2 * | 1/2007 | Lipowski | B02C 18/14 241/282 |
| 2005/0173570 | A1 * | 8/2005 | Tanaka | B02C 21/026 241/36 |
| 2011/0077821 | A1 * | 3/2011 | Yamaguchi | B02C 21/026 701/36 |
| 2015/0083835 | A1 * | 3/2015 | Lowe | B02C 18/2258 241/30 |
| 2016/0067713 | A1 * | 3/2016 | Okamoto | G01F 23/20 241/225 |

* cited by examiner

PROCESS FOR PRODUCING PULP FROM SUGAR BEETS

RELATED APPLICATION

This application is a Non-provisional Patent Application relating to and claiming the benefit of U.S. Provisional Patent Application Ser. No. 62/007,092 filed on Jun. 3, 2014.

FIELD OF THE INVENTION

This invention relates to the production of cassettes or pulp from sugar beets and, more particularly, to a process for optimizing the size of used cassettes or pulp, which are by-products of processes from extracting sugar from sugar beets.

BACKGROUND

After reception at the processing plant, sugar beet roots are washed, mechanically sliced into thin strips called cossettes, and passed to a diffuser or extraction tower to extract the sugar content into a water solution.

Diffusers are long vessels of many meters in which the beet slices go in one direction while hot water goes in the opposite direction. The movement may either be caused by a rotating screw or the whole unit rotating, and the water and cossettes move through internal chambers. The three common designs of diffuser are the horizontal rotating, inclined screw, and vertical screw "Tower." Modern tower extraction plants have a processing capacity of up to 17,000 metric tons per day. A less common design uses a moving belt of cassettes, with water pumped onto the top of the belt and, poured through. In most cases, the flow rates of cassettes and water are approximately equal to a 1:2 ratio. Typically, cassettes take about ninety minutes to pass through the diffuser, while the water takes forty-five minutes. These countercurrent exchange methods extract more sugar from the cassettes using less water than if they merely sat in a hot water tank for a period of time. The liquid exiting the diffuser is called raw juice. The color of raw juice varies from black to a dark red depending on the amount of oxidation, which is itself dependent on diffuser design.

The used cossettes, or pulp, exit the diffuser at about ninety-five percent moisture, but low sucrose content. Using screw presses, the wet pulp slabs are then pressed down to seventy-five percent moisture. This recovers additional sucrose in the liquid pressed out of the pulp and reduces the energy needed to dry the pulp. The pressed pulp is dried and sold as animal feed, while the liquid pressed out of the pulp is combined with the raw juice or, more often, introduced into the diffuser at the appropriate point in the countercurrent process. Another byproduct, vinasse, is used as fertilizer or growth substrate for yeast cultures.

During diffusion, a portion of the sucrose breaks down into invert sugars. These sugars can undergo further breakdown into acids. These breakdown products are not only losses of sucrose, but also have knock-on effects reducing the final output of processed sugar from the factory. To limit thermophilic bacterial action, the feed water may be dosed with formaldehyde and control of the feed water pH is also practiced. Attempts at operating diffusion under alkaline conditions have been made, but the process has proven problematic. The improved sucrose extraction in the diffuser is offset by processing problems in the next stages.

There are benefits in using a pulp-size optimizer in sugar beet processing facilities which have to slice beets and must produce so-called slabs of the sugar beets in order to obtain continuous operation in sugar extraction system: For example, sugar beet slabs will be more thermo stable and allow the countercurrent flow which will allow the extraction of the sucrose. During the period of beet processing, normal beet cossette size using prior art processes often simply plug the extraction systems due to the thermal influence, creating just "mush" and prohibiting counter current juice flows in the system.

For the reasons advanced above, there exists a need for a pulp optimizer apparatus for optimizing the size of used cossettes or pulp which are by-products of processes from extracting sugar from sugar beets.

SUMMARY OF THE INVENTION

In accordance with one form of the present invention, there is provided an apparatus for producing uniformly sized sugar beet cossettes, the apparatus including a frame; a first cutting shaft assembly adjacent to a second cutting shaft assembly on the frame, each of the first and second cutting shaft assemblies including a shaft in connection with a gear motor, and the gear motor being structured and disposed for mechanically rotating the shaft; a plurality of discs supported on the shaft; and a plurality of blades extending outwards from each of the plurality of discs; wherein the first and second cutting shaft assemblies are configured for interlaced counter-rotation of each of the plurality of discs; and a chute on the frame, and the chute including sidewalls defining an open-ended channel that is sized and configured for directing the sugar beet cossettes onto the first and second cutting shaft assemblies, and wherein the sugar beet cossettes are cut into uniformly sized sugar beet cossettes by the plurality of blades on each of the interlaced, counter-rotating plurality of discs.

In accordance with another form of the present invention, there is provided an apparatus for producing uniformly sized sugar beet cossettes in combination with a scroll for egress of the optimized pulp, the apparatus including a stationary frame; a first cutting shaft assembly adjacent to a second cutting shaft assembly and each being supported above the scroll by the stationary frame, each of the first and second cutting shaft assemblies including a shaft in connection with a gear motor, and the gear motor being structured and disposed for mechanically rotating the shaft; a plurality of discs supported on the shaft; and a plurality of blades extending outwards from each of the plurality of discs; wherein the first and second cutting shaft assemblies are configured for interlaced counter-rotation of each of the plurality of discs; and wherein the sugar beet cossettes introduced to the first and second cutting shaft assemblies are cut into uniformly sized sugar beet cassettes by the plurality of blades on each of the interlaced; counter-rotating plurality of discs.

BRIEF DESCRIPTION OF THE DRAWINGS

The description refers to the accompanying schematic drawings in which like reference characters refer to like parts throughout the several views, and in which.

Like reference numerals refer to like parts throughout the several views of the drawings.

DETAILED DESCRIPTION OF THE EMBODIMENTS

Referring to the several views of the drawings, the pulp optimizer of the present invention is shown and described herein and is generally indicated as 10.

As will be discussed below, it is desirable to produce cassettes or pulp 100 which are uniform in size. This is accomplished by placing a pulp optimizer 10 preferably where the cassettes or pulp 100 exits the diffuser 102 and prior to the pulp 100 entering the pulp pressing station 104.

Figure 1:
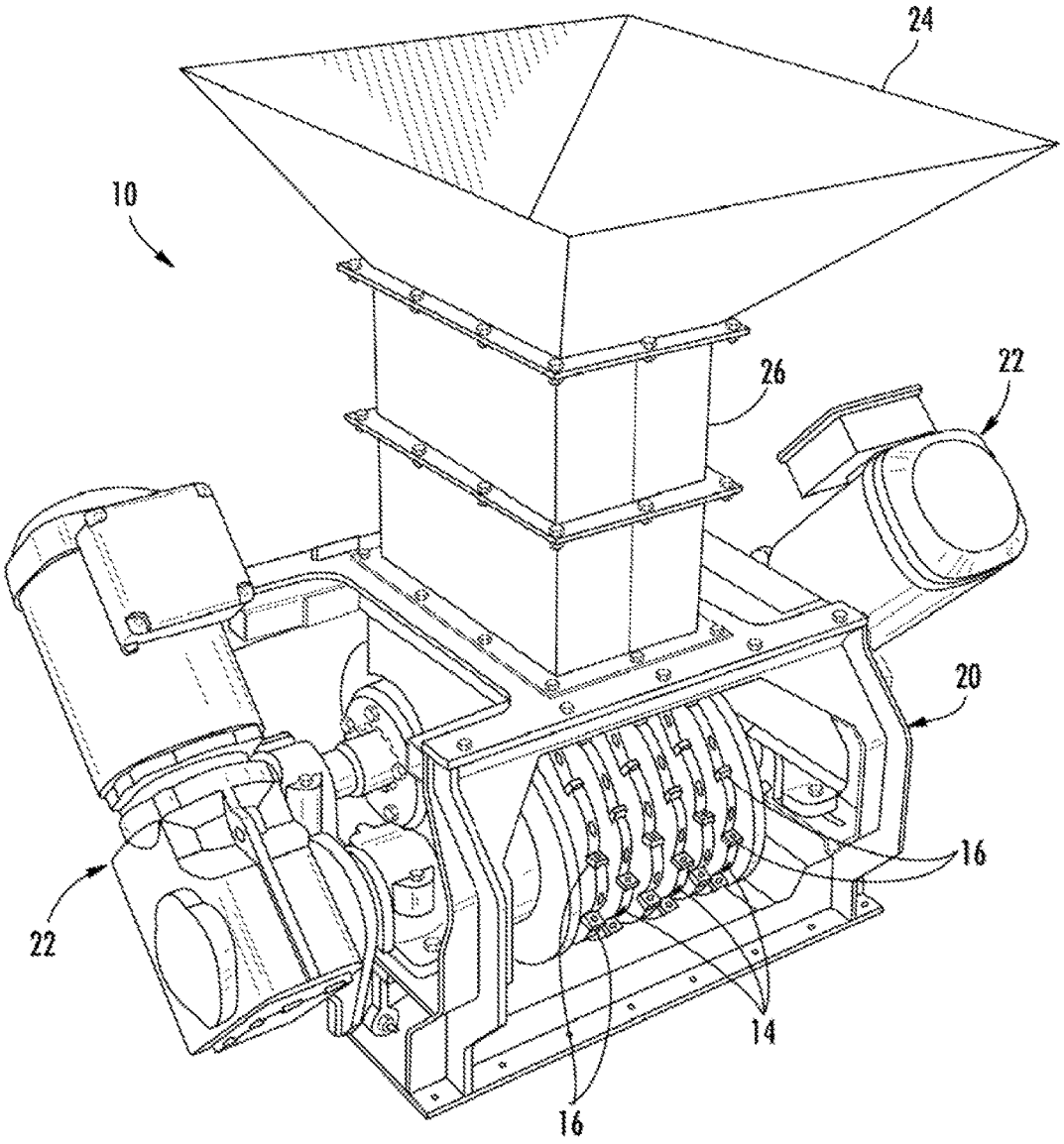
FIG. 1 is a perspective view of the pulp optimizer apparatus of the present invention in accordance with one embodiment.
Figure 2:
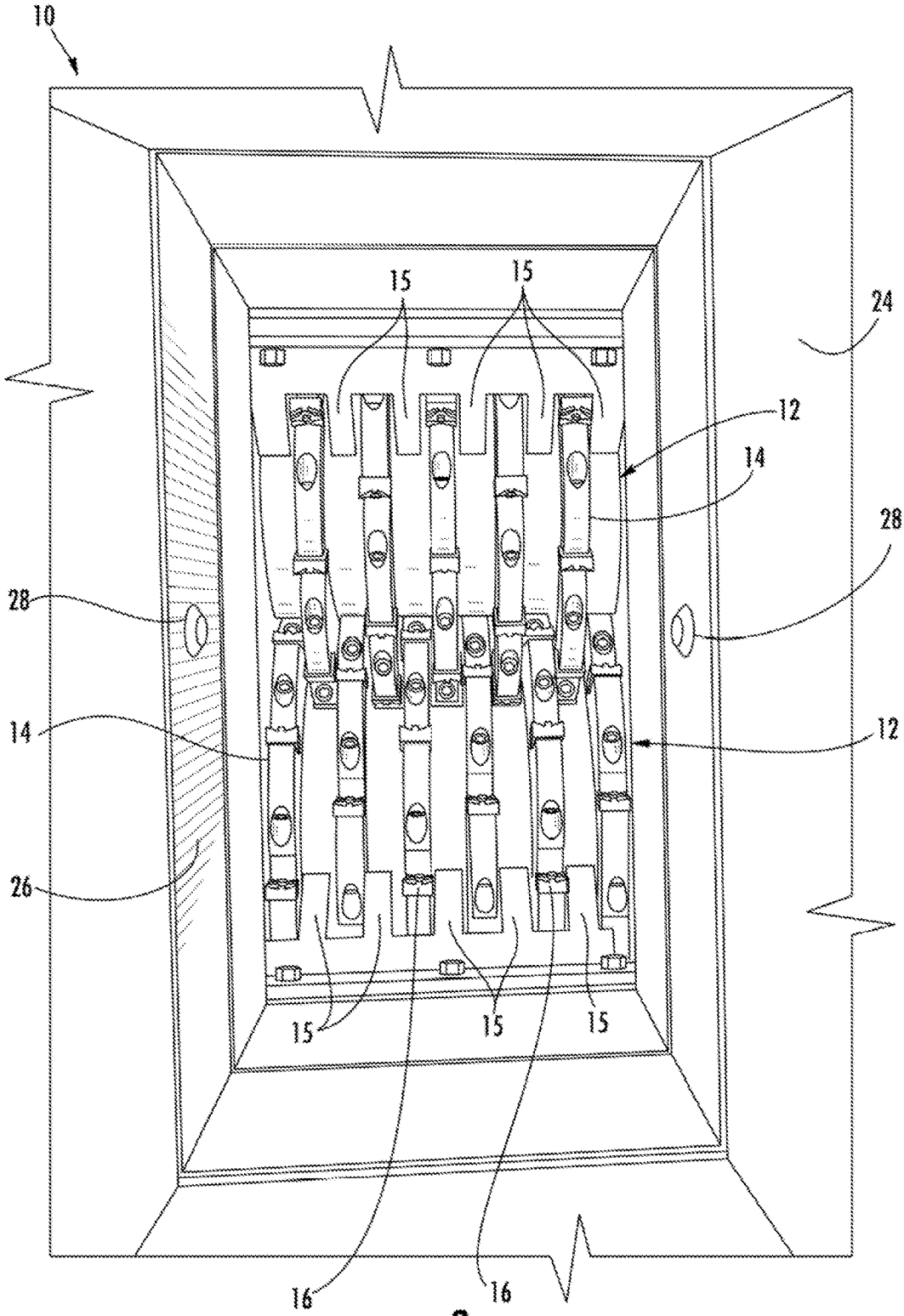
FIG. 2 is an isolated top plan view of the beet hopper, chute and cutting shaft assembly of the pulp optimizer apparatus in accordance with the embodiment illustrated in FIG. 1.
Figure 5:
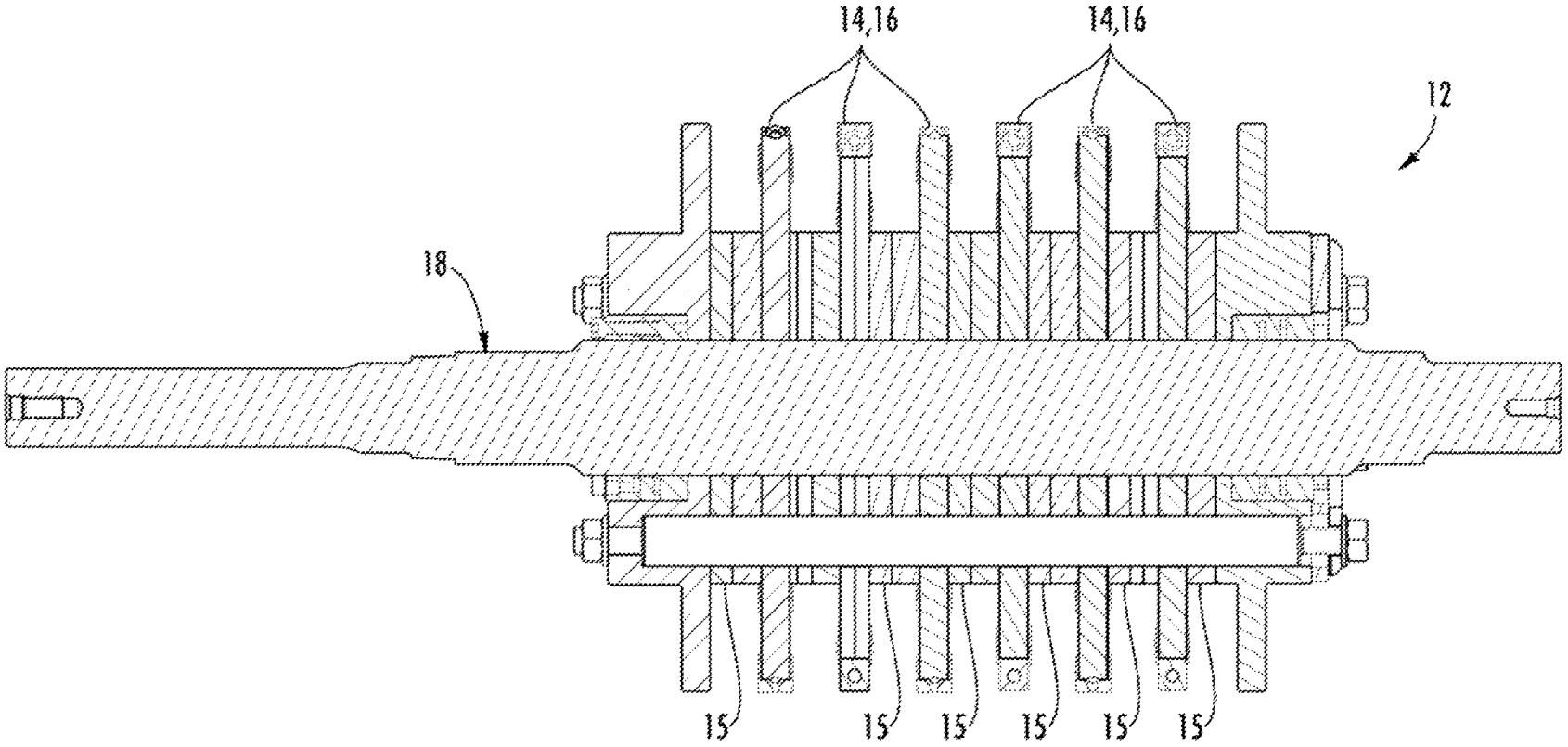
FIG. 5 is a side view, shown in partial cross-section, illustrating the cutting shaft assembly of the pulp optimizer apparatus in accordance with the embodiment illustrated in FIG. 1.
Figure 6:
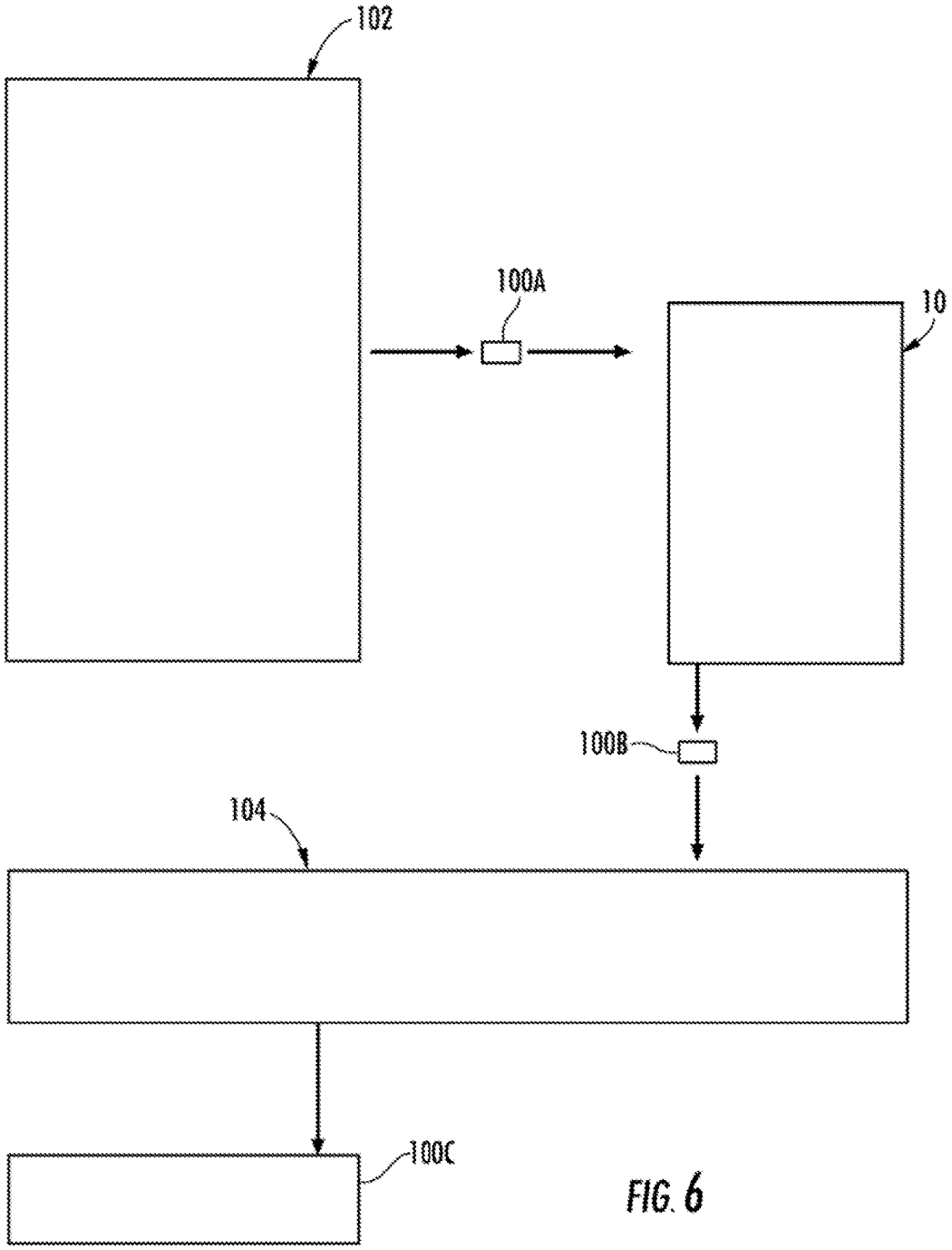
FIG. 6 is a flow diagram illustrating the pulp production process, including a diffuser, the pulp optimizer of the present invention, an a pulp press.

Referring to FIGS. 1 and 2, a first embodiment of the pulp optimizer apparatus 10 preferably includes two counter-rotating cutting shaft assemblies 12. Each cutting shaft assembly 12 includes a plurality of discs 14 held in place by spacers 15. Each of the plurality of discs 14 includes a plurality of cutter inserts 16 (i.e., blades) extending outwards from each of the plurality of discs 14, which are each connected to shaft 18 (FIG. 5). A portable frame assembly 20 supports the cutting shaft assemblies 12 and opposing gear motors 22, which are structured for providing the necessary torque to rotate the cutting shaft assemblies 12. It is considered that the portable frame assembly 20 includes one or more wheels for assisting in transportation of the apparatus 10. A beat hopper 24 and chute 26 are also mounted to the frame assembly and se e to capture the cossettes or pulp 100 exiting the diffuser 102 and direct it towards the counter-rotating cutting shaft assemblies 12. The preferred location of the optimizer apparatus 10 would be somewhere at the discharge site of the extraction system prior to the point where the slabs enter the pulp presses, preferably where the slabs exit the diffuser. FIG. 6 illustrates the preferred process and location of the pulp optimizer apparatus 10 between the diffuser 102 and the pulp press station 104.

The preferred clearance between each of the plurality of discs 14 and, therefore, cutter inserts 16, is approximately 7 mm, which is the standard size of cossettes or pulp 100 during fresh sugar beet slicing season. It is considered, however, that a pulp optimizer apparatus 10 may be readily manufactured to include a plurality of discs 14 at various clearances, as required. The material selection of the apparatus 10 would meet the requirement of the low pH product which also addresses the wear resistance.

In one embodiment, the counter-rotating cutting shaft assemblies 12 rotate at different speeds and the capacity would be correspondingly controlled by variable speed frequency drives. The larger size beet particles would be reduced by the blades 16 to the more uniform size of 7 mm. One or more sensors 28, such as optical sensors, may be used to communicate with the gear motors 22 for automatic adjustment of the rotation speed of the counter-rotating cutting shaft assemblies 12. In operation, the one or more sensors 28 detect the volume of the cossettes or pulp 100 entering the chute 26 and deliver a signal to the gear motors 22 for speeding up or slowing down the rotation of one or both counter-rotating cutting shaft assemblies 12 accordingly.

Figure 3:
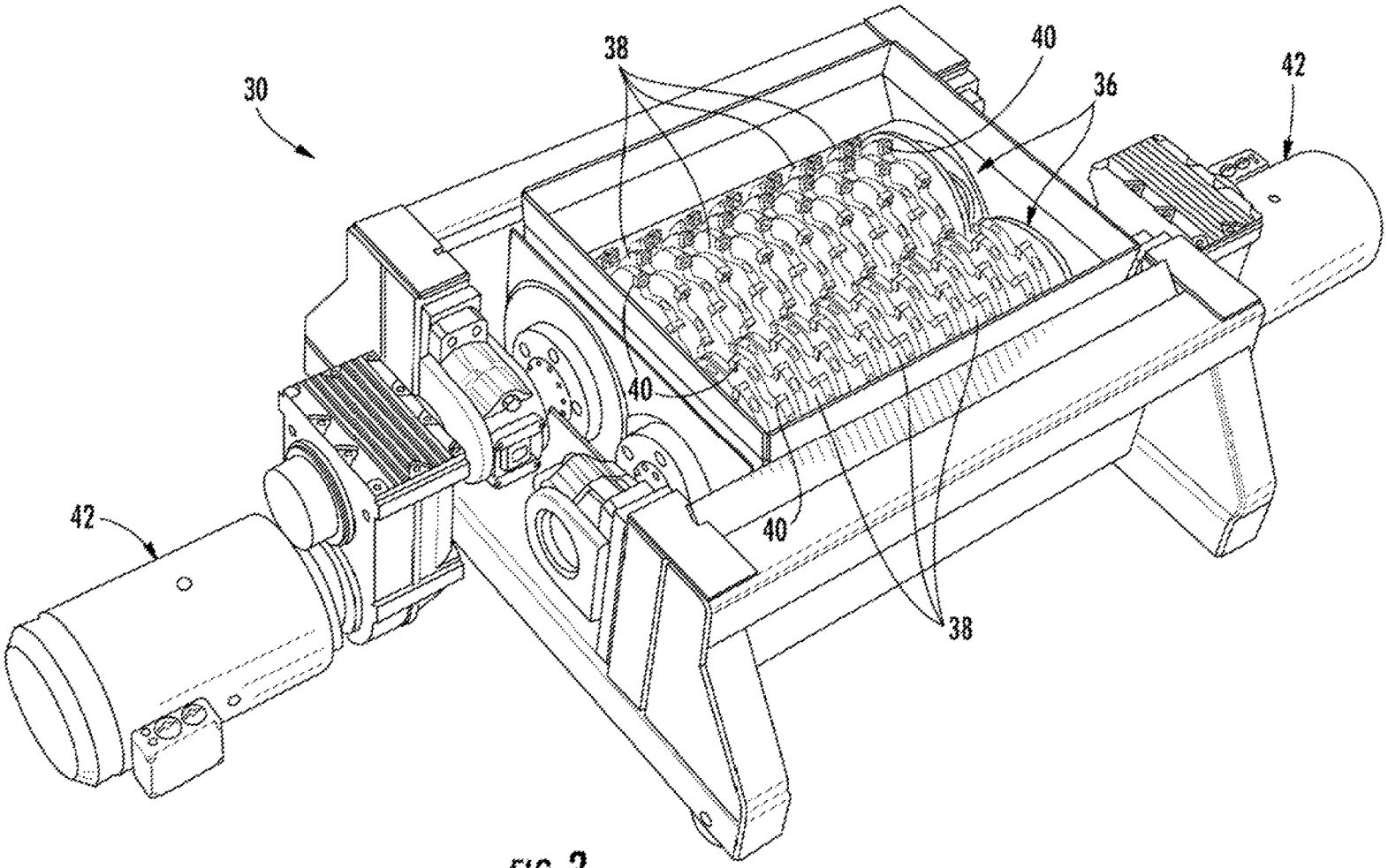
FIG. 3 is a perspective view of the pulp optimizer apparatus of the present invention in accordance with another embodiment.
Figure 4:
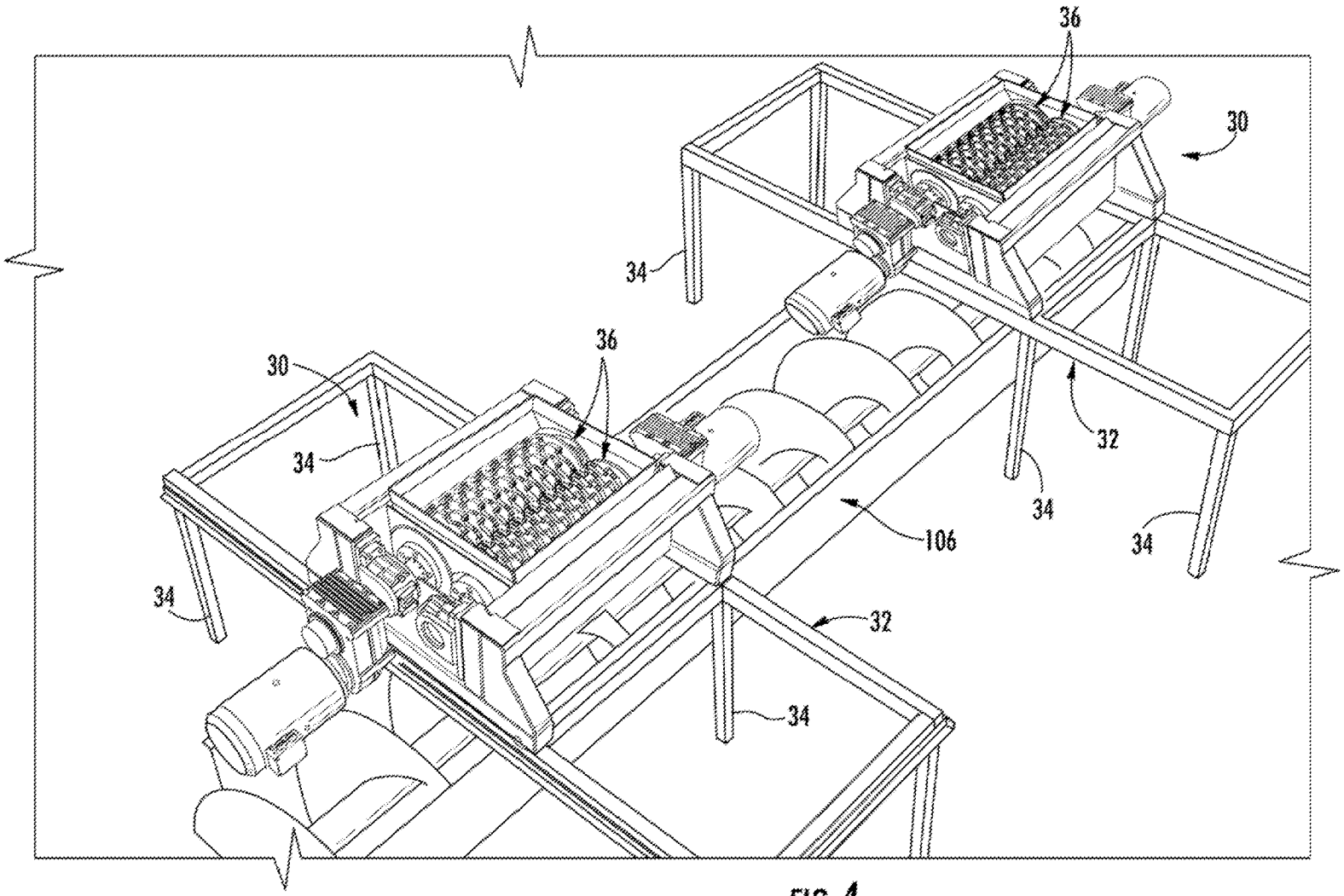
FIG. 4 is a perspective view of a dual unit configuration illustrating a first pulp optimizer apparatus and a second pulp optimizer apparatus in accordance with the embodiment illustrated in FIG. 3.

Referring to FIGS. 3 and 4, another embodiment of the pulp optimizer apparatus 30 is shown and includes a frame assembly 32 having legs 34 sized and configured for supporting the pulp optimizer apparatus 30 above a scroll 106 for egress of the optimized pulp. Similar to the first embodiment, the pulp optimizer apparatus 30 includes two counter-rotating cutting shaft assemblies 36. Each cutting shaft assembly 36 includes a plurality of discs 38. Each of the plurality of discs 38 includes a plurality of cutter inserts 40 (i.e., blades) extending outwards from the disc 38. The frame assembly 32 supports the cutting shaft assemblies 36 and opposing gear motors 42, which are structured for providing the necessary torque to rotate the cutting shaft assemblies 36. As specifically shown in FIG. 4, this embodiment of the pulp optimizer apparatus 30 is stationary and is ideal for factory layouts wherein multiple pulp optimizer apparatuses 30 are used. The pulp optimizer 30 may include a beat hopper and chute mounted to the frame assembly 32 for capturing the cossettes or pulp 100 exiting the diffuser 102 acid direct it towards the counter-rotating cutting shaft assemblies 36. Moreover, pulp optimizer apparatus 30 may include sensors for detecting the volume of cossettes or pulp 100 being introduced to the counter-rotating cutting shaft assemblies 36, as described above.

There are additional benefits of using the pulp optimizer apparatus 10. First, the uniform pulp size would result in lower pressed pulp moisture, which can otherwise be problematic due to thicker slabs not releasing the moisture as quickly as smaller slabs. Moreover, uniform pulp size would increase the capacity of the pulp pressing station 104.

Second, the propensity of pulp to over-dry would greatly benefit more uniform pulp size. During the beet processing time, a higher amount of thermal energy is required from the pulp dryers to reduce the moisture of the existing pulp, which leads to increased costs. Difficulties are also present at the steam pulp drier systems because the larger particles of the pulp have the tendency to separate in the system and periodically cause operation interruptions.

Third, more uniform pulp sizes exiting the pulp dryer system would greatly increase the pelletizing of the pulp (animal feed). In the pelletizing process, the dried pulp is forced by extreme pressure through a die, creating a hard compressed pellet. During the beet processing time, a large amount of large slabs do enter the pulp press station and create pelletizing problems and reduce the pellet mill's capacity, Also, in presently available systems, there are increased maintenance problems and discharge of unpelletized pulp which has to be sold at a much lower price.

Referring to FIG. 6, a simplified illustration of a processing plant for extracting sugar from sugar beets is shown. The cossettes or pulp 100A exits the diffuser 102 and enters the pulp optimizer apparatus 10 (through beat hopper 24 and chute 26), exiting therefrom as uniformly sized cassettes or pulp 100B. The uniformly sized cassettes or pulp 100B exit the pulp optimizer apparatus 10 and enter the pulp pressing station 104, which forms the final product cossettes or pulp 100C.

From the foregoing description of one embodiment of the invention, it will be apparent that many modifications may be made therein. It will be understood that this embodiment of the invention is an exemplification of the invention only and that the invention is not limited thereto.

While the present invention has been shown and described in accordance with several preferred and practical embodiments, it is recognized that departures from the instant disclosure are contemplated within the spirit and scope of the present invention which are not limited except as defined in the following claims as interpreted by the Doctrine of Equivalents.

What is claimed is:

1. A method of processing a plurality of sugar beet, the method including the steps of:

washing and slicing the plurality of sugar beet into a plurality of sugar beet cossettes;

providing the plurality of sugar beet cossettes;

providing a diffuser for diffusing the plurality of sugar beet cossettes; and providing an apparatus for receiving the plurality of sugar beet cossettes and producing a plurality of uniformly sized sugar beet cossettes from the plurality of sugar beet cossettes, said apparatus comprising:

a frame;

a first cutting shaft assembly adjacent to a second cutting shaft assembly on said frame, and each of said first and second cutting shaft assemblies comprising:

a shaft in connection with a gear motor, and said gear motor being structured and disposed for mechanically rotating said shaft;

a plurality of discs supported on said shaft; and a plurality of blades each extending outwards from each of said plurality of discs;

wherein said first and second cutting shaft assemblies are configured for interlaced counter-rotation of each of said plurality of discs so that each of said plurality of blades on said first cutting shaft assembly interlaces with each corresponding blade of said plurality of blades on said second cutting shaft assembly;

a chute on said frame, and said chute including sidewalls defining an open-ended channel that is sized and configured for receiving the plurality of sugar beet cossettes from said diffuser and directing the plurality of sugar beet cossettes onto said first and second cutting shaft assemblies, and wherein the plurality of sugar beet cossettes are cut into the plurality of uniformly sized sugar beet cossettes by said plurality of blades on said interlaced, counter-rotating plurality of discs;

at least one optical sensor for detecting the volume of the plurality of sugar beet cossettes entering said chute and delivering a signal to each of said gear motors for automatically adjusting the rotation speed of one or both of said shafts; and wherein each of said shafts is structured and disposed to selectively rotate at different speeds relative to each other.

2. A method of processing a plurality of sugar beet in combination with a scroll, the method including the steps of:

washing and slicing the plurality of sugar beet into a plurality of sugar beet cossettes;

providing the plurality of sugar beet cossettes;

providing a diffuser for diffusing the plurality of sugar beet cossettes; and providing an apparatus for receiving the plurality of sugar beet cossettes and producing a plurality of uniformly sized sugar beet cossettes from the plurality of sugar beet cossettes, said apparatus comprising:

a stationary frame;

a first cutting shaft assembly adjacent to a second cutting shaft assembly and each being supported above the scroll by said stationary frame, and each of said first and second cutting shaft assemblies comprising:

a shaft in connection with a gear motor, and said gear motor being structured and disposed for mechanically rotating said shaft;

a plurality of discs supported on said shaft; and a plurality of blades each extending outwards from each of said plurality of discs;

wherein said first and second cutting shaft assemblies are configured for interlaced counter-rotation of each of said plurality of discs so that each of said plurality of blades on said first cutting shaft assembly interlaces with each corresponding blade of said plurality of blades on said second cutting shaft assembly;

wherein the plurality of sugar beet cossettes introduced onto said first and second cutting shaft assemblies are cut into the plurality of uniformly sized sugar beet cossettes by said plurality of blades on said interlaced, counter-rotating plurality of discs;

at least one optical sensor for detecting the volume of the plurality of sugar beet cossettes slices entering said chute and delivering a signal to each of said gear motors for automatically adjusting the rotation speed of one or both of said shafts; and wherein each of said shafts is structured and disposed to selectively rotate at different speeds relative to each other.

* * * * *